US005181501A

United States Patent [19]

Lien

[11] Patent Number: 5,181,501

[45] Date of Patent: Jan. 26, 1993

[54] PING-PONG BALL SHOOTER

[76] Inventor: Wei M. Lien, No. 16, Lane 402, Anping Rd., Sec. 2, Hsin-Chu City, Taiwan

[21] Appl. No.: 661,123

[22] Filed: Feb. 27, 1991

[51] Int. Cl.[5] ..... A63B 69/40

[52] U.S. Cl. ..... 124/10; 124/51.1; 124/16

[58] Field of Search ..... 124/10, 16, 1, 41.1, 124/51.1, 52; 273/29 R, 29 A, 30

[56] References Cited

U.S. PATENT DOCUMENTS

| | | | |
|---|---|---|---|
| 2,199,009 | 4/1940 | Perryman | 124/1 |
| 3,606,987 | 9/1971 | Nomura | 273/30 |
| 4,116,438 | 9/1978 | Berliner | 124/1 |
| 4,765,618 | 8/1988 | Daley | 273/30 |
| 4,917,380 | 4/1990 | Gatchel et al. | 273/30 |

FOREIGN PATENT DOCUMENTS

| | | | |
|---|---|---|---|
| 13934 | 2/1977 | Japan | 124/16 |
| 46634 | 4/1979 | Japan | 273/30 |

*Primary Examiner*—Randolph A. Reese
*Assistant Examiner*—Jeffrey L. Thompson
*Attorney, Agent, or Firm*—Bacon & Thomas

[57] ABSTRACT

A ping-pong ball shooter including a reciprocating arm mechanism composed of an abruptly returning device capable of shooting out a ball, a rotating mechanism, a ball feeding/regaining device, an eye ball reciprocating mechanism and speed changing device, whereby by means of slider-crank mechanism in four linkages, the eye ball reciprocating mechanism can rotate left and right and up and down like an eye, making the shot out ping-pong balls scattered within a sector area of a ping-pong table, and the rotation direction, bounding speed and bounding strength of the ball can be controlled, and the shot out balls can be recollected into a ball collector through a hopper slide way and a sleeve ball bag, one end of the sleeve ball bag being open and inserted into the slide way and the other end thereof being closed, serving as a driving end, three sets of blades and openings being disposed therein whereby when rotating, due to centrifugal force, the balls slide through the opening into ball pipe to be pushed by the blades upward along the ball pipe into a T-shaped pipe having a spring, ready ball tunnel and ball spilling pipe, permitting the balls to freely drop into the ready ball tunnel, and if the same is filled with other balls, a pressing spring forces the balls to the ball spilling pipe to slide back to the sleeve ball bag.

10 Claims, 9 Drawing Sheets

PING-PONG BALL SHOOTER

BACKGROUND OF THE INVENTION

The present invention relates to a ping-pong ball shooter. Generally, a conventional ping-pong ball shooter employs a ball-striking swinging mechanism with a torque spring to achieve the object of shooting balls. However, although such shooter has simple structure, the shooting path is too monotonous so that the user or trainee will feel bored will not obtain real game experience, and will even feel that such ping-pong shooter is useless. Some other types of conventional ping-pong ball shooters employ complex mechanically controlling devices to achieve various functions. However, such device must be operated by another person, are composed of many components and requires long assembling time so that the cost thereof is too high. Such devices can not be mass manufactured and widely used.

SUMMARY OF THE INVENTION

It is a primary object of this invention to provide a ping-pong ball shooter employing a slider-crank mechanism with four linkages to achieve various dropping positions and speeds of the shot ping-pong balls.

It is a further object to provide a ping-pong ball shooter which can be easily assembled and disassembled and in which the structure is simplified to lower the manufacturing cost.

BRIEF DESCRIPTION OF THE DRAWINGS

The invention as well as its many advantages may be further understood by reference to the following detailed description and drawings in which.

DETAILED DESCRIPTION OF THE PREFERRED EMBODIMENT

Figure 1:
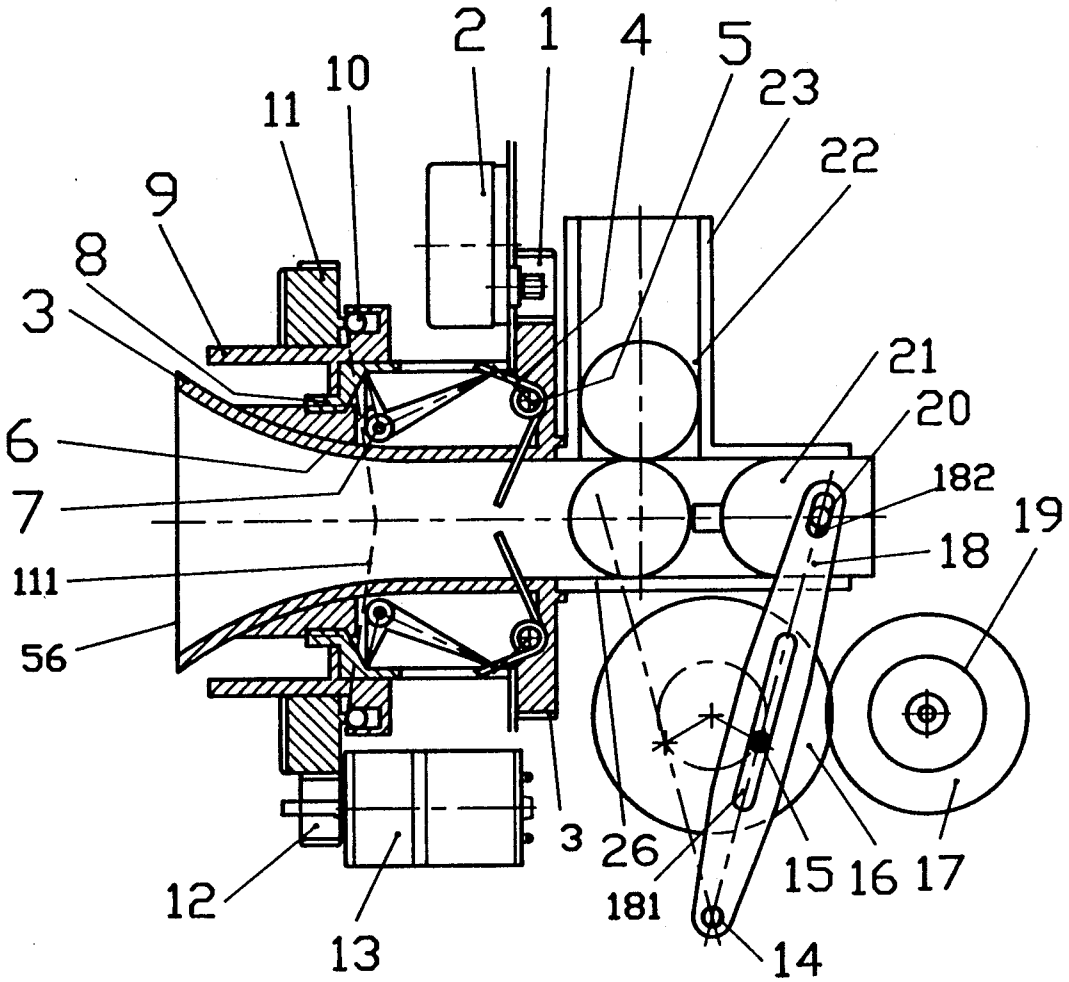
FIG. 1 is a cross-sectional view of the shooting strength adjusting mechanism of this invention.
Figure 2:
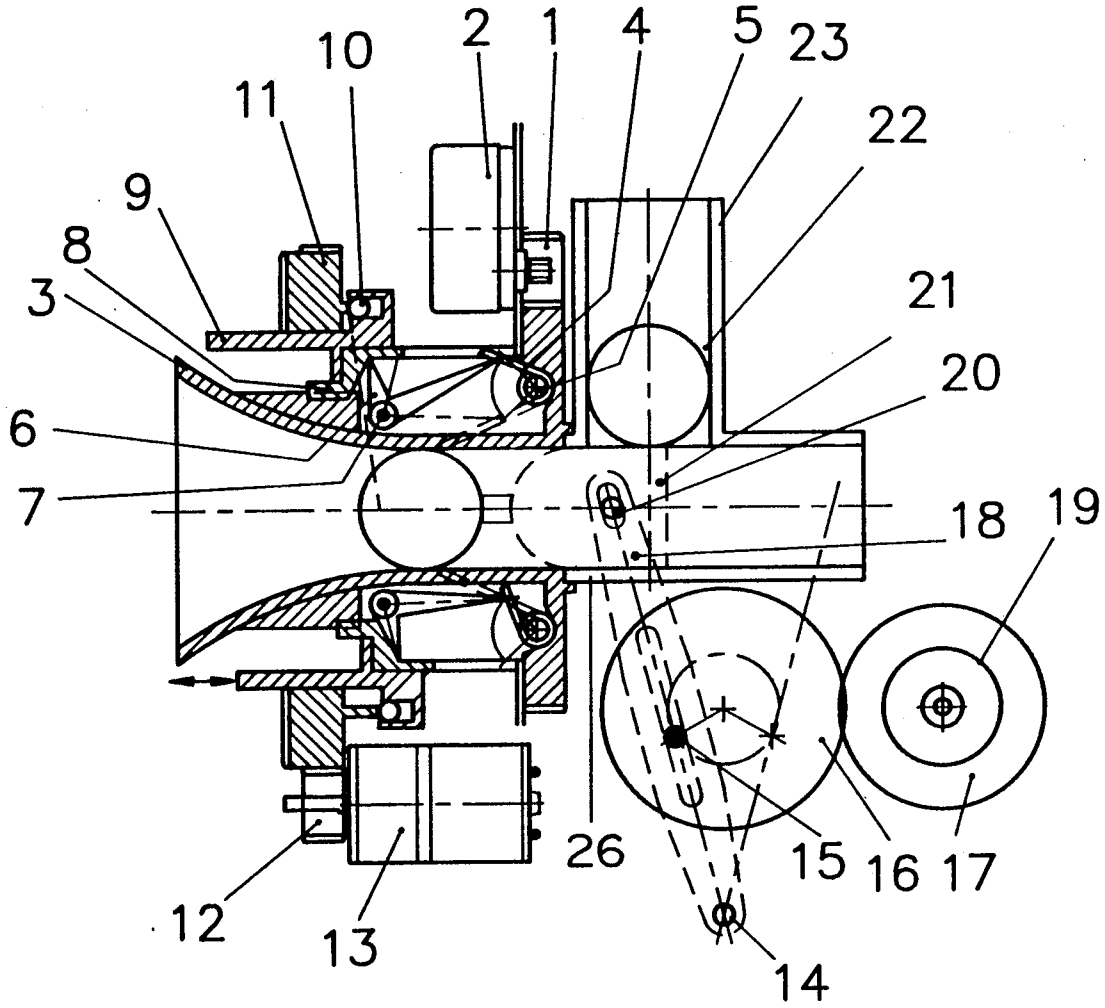
FIG. 2 is a view similar to FIG. 1 showing a ball being pushed out of the device according to the invention.

Please refer to FIGS. 1 and 2. The ping-pong ball shooter of this invention includes an abruptly returning mechanism, a rotating mechanism, a ball feeding-/regaining device, an eye ball reciprocating mechanism, and a speed changing device of a reciprocating arm, wherein the rotating mechanism includes a motor 2, a small gear 1 driven thereby and a large gear 3 which is driven by the small gear 1 and in which a ball pipe 26 and a torque spring seat are disposed. A torque spring 4 is loosely disposed on a pin 5 with one end longer and the other end shorter, whereby when the large gear 3 rotates, the torque spring 4 rotates 360 degrees along therewith. The abruptly returning mechanism of the reciprocating arm includes a DC motor 19, driving gear 17, driven gear 16, crank pin 15, pivot pin 14, rocking arm 18, and a striking head 20 with an engaging pin 21, wherein when DC motor 19 rotates to make the driving gear 17 rotarily drive the driven gear 16, the crank pin 15 thus rotates along therewith and moves within a slot 181 of the rocking arm 18. Because the rocking arm 18 is fixed by the pivot pin 14, therefore it can only swing within a certain angle about the pivot pin 14. As a consequence, the engaging pin 20 can slide within a slot 182 of the rocking arm with the striking head 21 horizontally sliding in the ball pipe 26.

When a ping-pong ball 22 is dropped into a ready position through a ball tunnel 23, the rocking arm 18 rocks to move the striking head 21 forward so as to push the ball 22 toward the torque spring 4 to bias the same outward. When the rocking arm 18 reaches a final position (indicated by dotted line in FIG. 2), the torque spring 4 will be restored into its original position to abruptly shoot out the ball 22. The speed of the shot ball is abjusted in such a manner that the crank pin 15 is located to achieve different rotating angles, making the advancing rotating angle of the rocking arm 18 larger than the backing rotating angle thereof, i.e. the advancing stroke is slow and the backing stroke is fast. Moreover, the DC motor 19 serves as a power source and can be adjusted to achieve various speeds of the shot ball as required.

Figure 3:
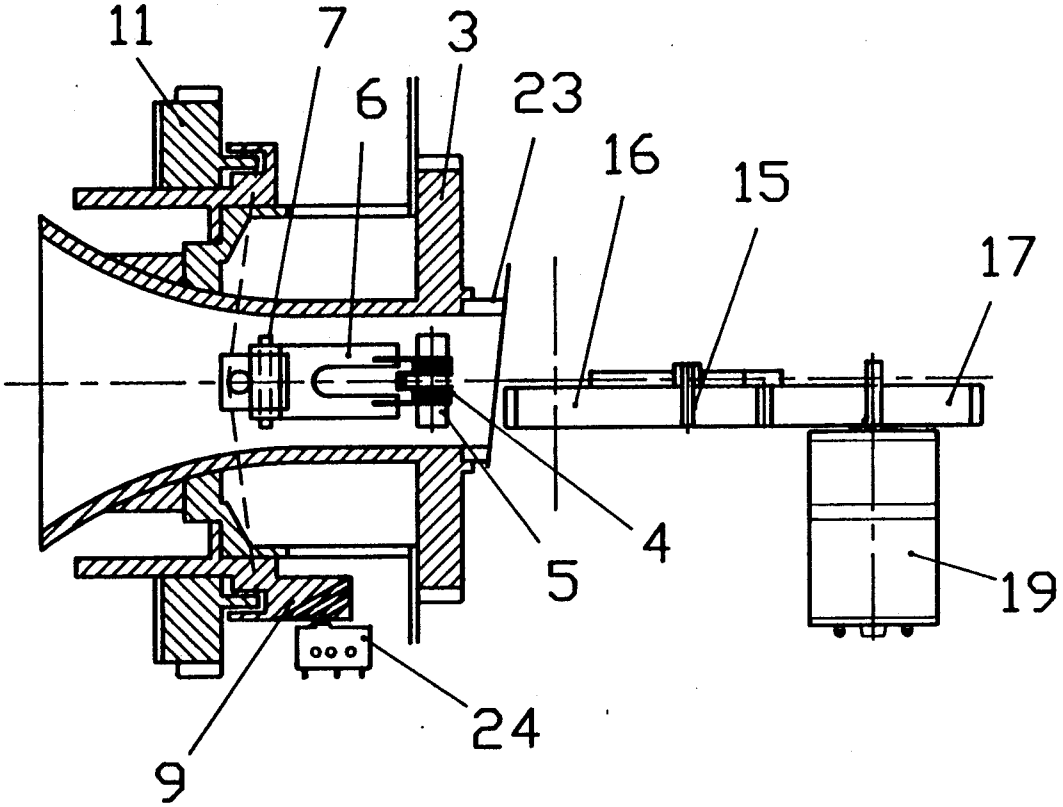
FIG. 3 is a top cross-sectional view of the device of FIG. 1.

Please refer to FIGS. 1, 2, and 3, wherein the strength of shooting force exerted on the ball 22 is primarily controlled by means of changing the tension of the torque spring 4, i.e. changing the angle of the torque spring 4. One end of the torque spring 4 is mounted on a swinging lever 6 which is loosely mounted on a pivot pin 7. Two sets of the torque springs 4 are symmetrically fixed on the larger gear 3 to rotate along therewith. Additionally, a rotating pushing disk 8 is also disposed on the large gear 3 to reciprocally slide and rotate whereby when the rotating pushing disk 8 moves to push the swinging lever 6 and change its angle, the angle of the torque spring 4 is thus also changed to achieve different tension so as to change the strength of shooting force for the ball 22.

The elements for reciprocating the rotating pushing disk 8 are a motor 13, a small gear 12, a large gear 11, a steel ball 10 and a slide guide 9, wherein the large gear 11 is provided with a cam 111, and the steel ball 10 is disposed between the cam 111 and slide guide 9 so that when the large gear rotates, the cam 111 rotates along therewith to push the slide guide back and forth, forcing the rotating pushing disk 8 to move. The cam 111 rotates through 360 degrees wherein from zero degrees to 90 degrees, i.e. from the lowest position to the highest position, the torque spring 4 is compressed to a most tensioned state and the ball can be shot out most strongly, and from 90 degree to 180 degree, i.e. from the highest position to the lowest position, the torque spring 4 is released to a free state and the shooting force is weakest. Accordingly, there are two up and down cycles in one revolution of the cam 111.

The slide guide 9 is formed with a projection so that, when within zero degrees to 90 degrees, the projection can touch a limit switch 24 to power on an indicator lamp for indicating the strength of shooting force. Because the slide guide 9 contacts with the rotating pushing disk 8 in a sliding frictional manner, therefore, when the large gear 11 is not rotated with the cam 111 staying in its original position, the slide guide 9 also stays where it is with the rotating pushing disk 8 located at a fixed position. However, due to the rotation of the large gear 3, although the rotating pushing disk 8 stays at the fixed position, the swinging lever 6 is urged to compress the torque spring 4 into a certain same tensional state, making the ball shooting force identical and the indicator lamp stays in a fixed point. If the motor 13 starts to rotate, then the strength of ball shooting force is also changed to achieve shooting force adjustment.

Figure 4:
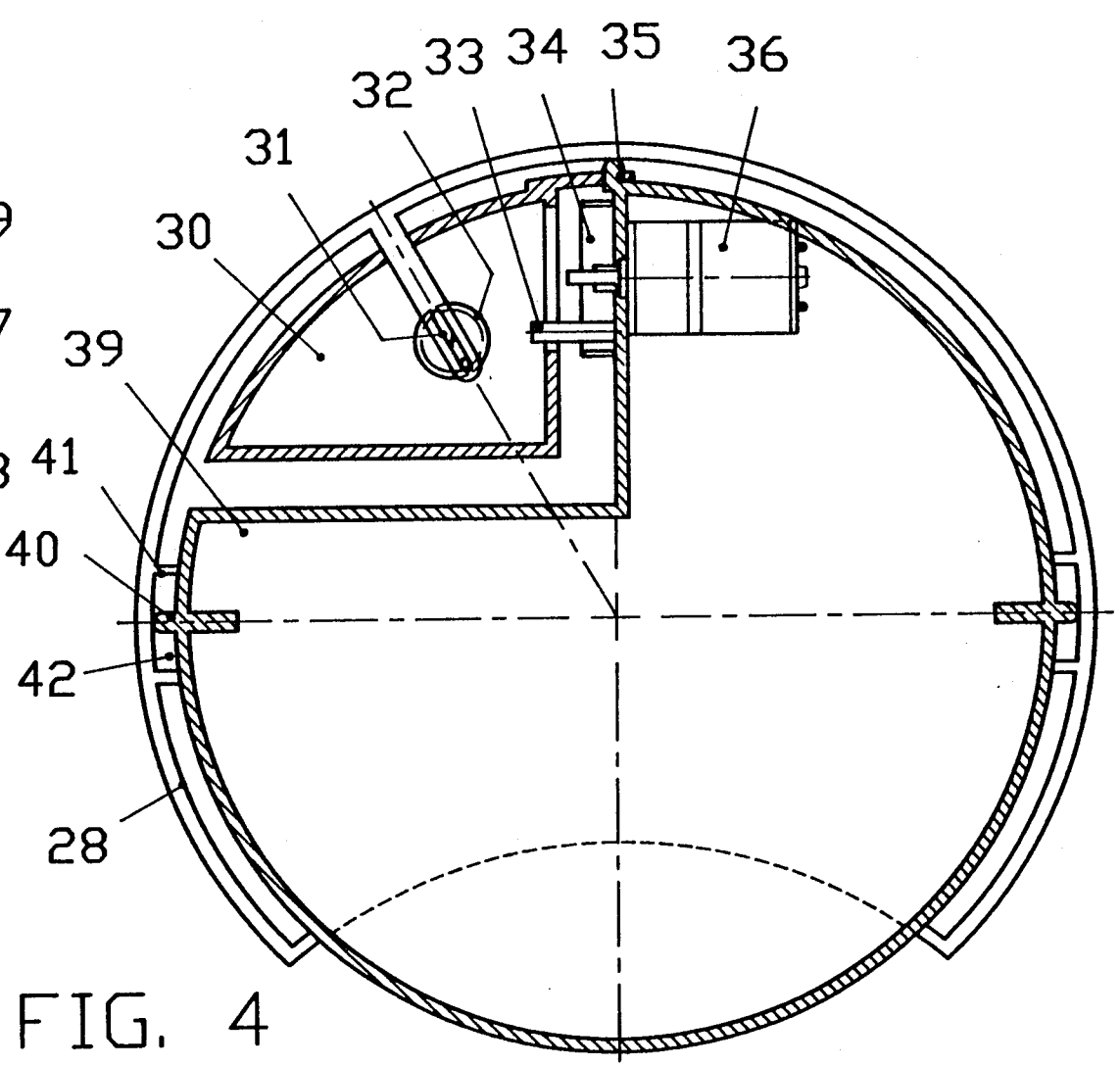
FIG. 4 is a cross-sectional view of the eye ball reciprocating mechanism of this invention.
Figure 4A:
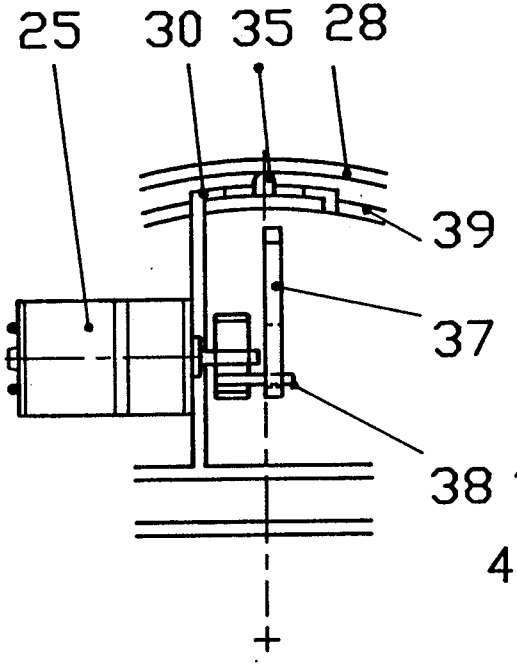
FIG. 4*a* is a front view of the vertical drive system according to the present invention.

Please now refer to FIG. 4 which shows the eye ball reciprocating mechanism of this invention wherein in a spherical structure 28 is disposed a seat member 41 having a slide slot 42 engaging with a fixing pin 40 formed on a rotary eye ball member 39, whereby the rotary eye ball member 39 can horizontally or vertically rotate inside and about the shperical structure 28 according to the slider-crank mechanism.

Figure 5:
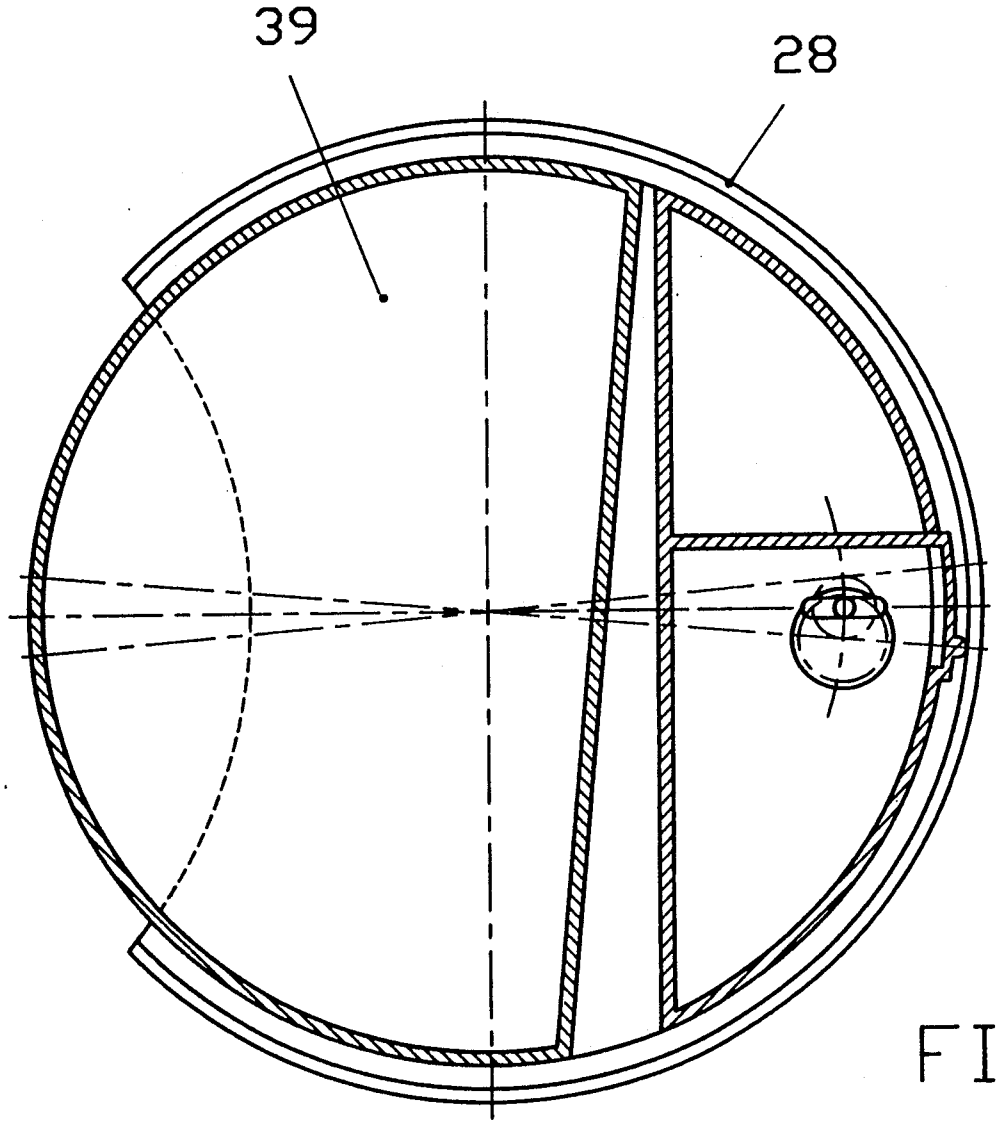
FIG. 5 is a view of horizontal swinging state of the mechanism of FIG. 4.

Moreover, a crank pin 33 is disposed on a transmission gear 34 of a horizontal motor 36 which is mounted on the rotary eye ball member 39 whereby the crank pin 33 can move within a guider 30. A ball pin 35 is disposed on the rotary eye ball member 39, which move within a slot of the guider 30 and is limited by the spherical structure 28, i.e. the eye ball member 39 can only move horizontally relatively to the guider 30. In addition, another crank pin 38 is disposed on a transmission gear 32 of a vertical motor 25, which can move within a fixing support 37 of the spherical structure 28. Because the guider 30 is also limited by the support 37 of the spherical structure 28, making the eye ball member 39 only move vertically, therefore, when the vertical motor 25 rotatably drives the transmission gear 32 to further drive the crank pin 38 to rotate about the transmission gear 32, since the fixing support 37 of the spherical structure 28 is kept stationary, the crank pin 38 will inevitably move within a slide slot 31 of the support 37, forcing the transmission gear 32 to rotate and make the eye ball member swing about its center. In FIG. 5, a limit swinging position of the eye ball member after the rotation of transmission gear 32 is shown. This is achieved according to the slider-crank mechanism in the four linkage.

Figure 6:
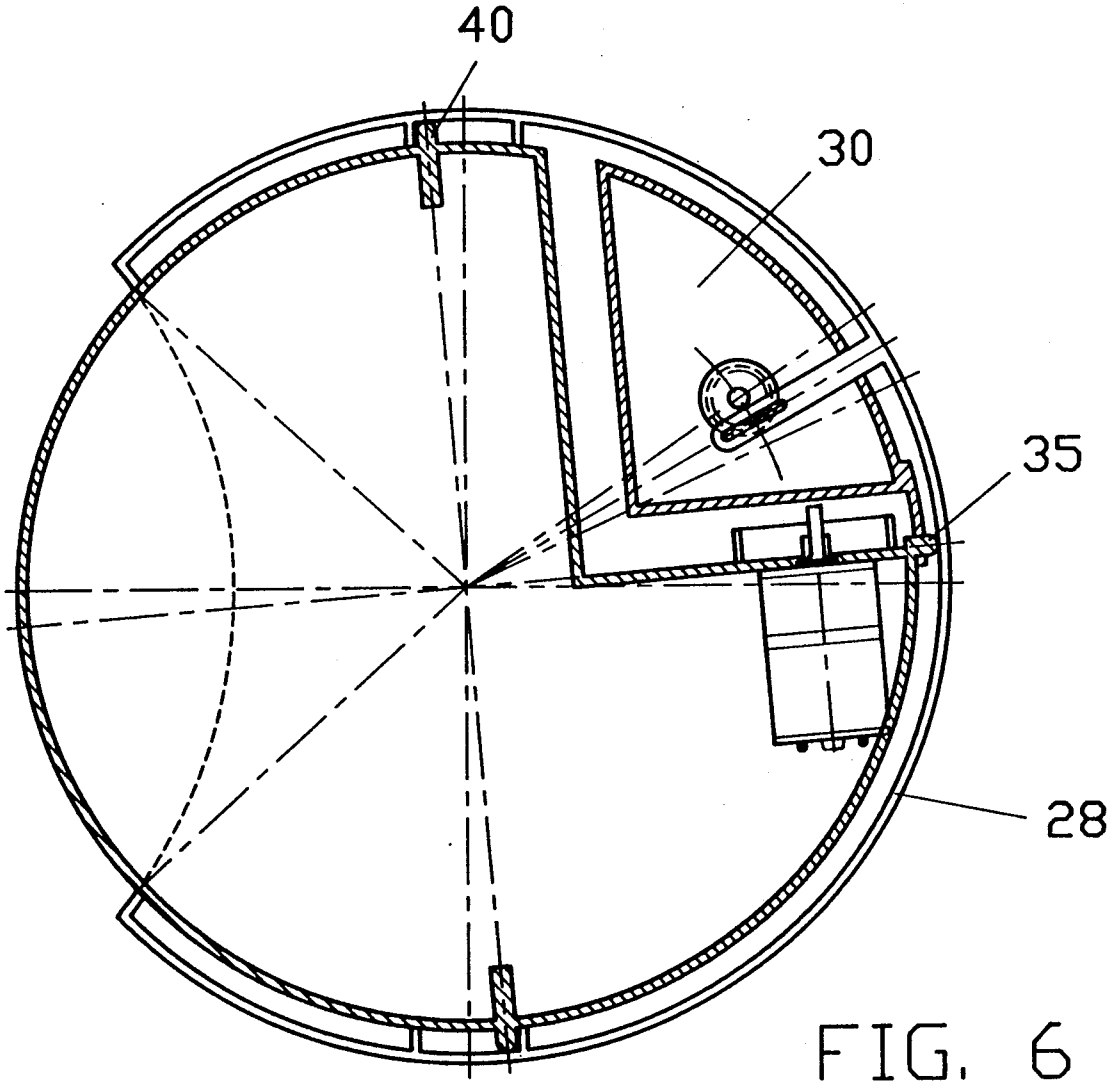
FIG. 6 is a view of vertically swinging state of the mechanism of FIG. 4.

As shown in FIG. 5, after the transmission gear 32 rotates, the eye ball member 39 is urged to swing, i.e., the guider 30 will drive the ball pin 35 to force the eye ball member 39 to vertically swing along with the guider 30 about the center of the spherical structure 28. Therefore, the crank pin 38 will move within the slide slot 31 back and forth once in one revolution of the transmission gear 32, i.e., the eye ball member 39 will move up and down once. Similarly, when the horizontal motor 36 rotarily drives the transmission gear 34 to further drive the crank pin 33 to move within the slide slot 26 of the guider 30, because the guider 30 is limited to only move vertically, after the transmission gear 34 is forced to rotate, the spherical structure will horizontally swing about its center as shown in FIG. 6. Therefore, in one revolution of the transmission gear 34, the crank pin 33 moves within the slide slot back and forth once, i.e., the eye ball member 39 horizontally swings left and right once. By means of the above two sets of four linkage slider-crank mechanism, the rotary eye ball member 39 can rotate upward, downward, left, and right in the spherical sturcture 28. Furthermore, the two sets of four linkage mechanism can move independently from each other to form only up and down or left and right movement, or can move together to form irregular variation so that the shot out balls will be scattered within a sector area of the ping-pong table and the dropping points of the balls can be altered regularly or irregularly.

Figure 7:
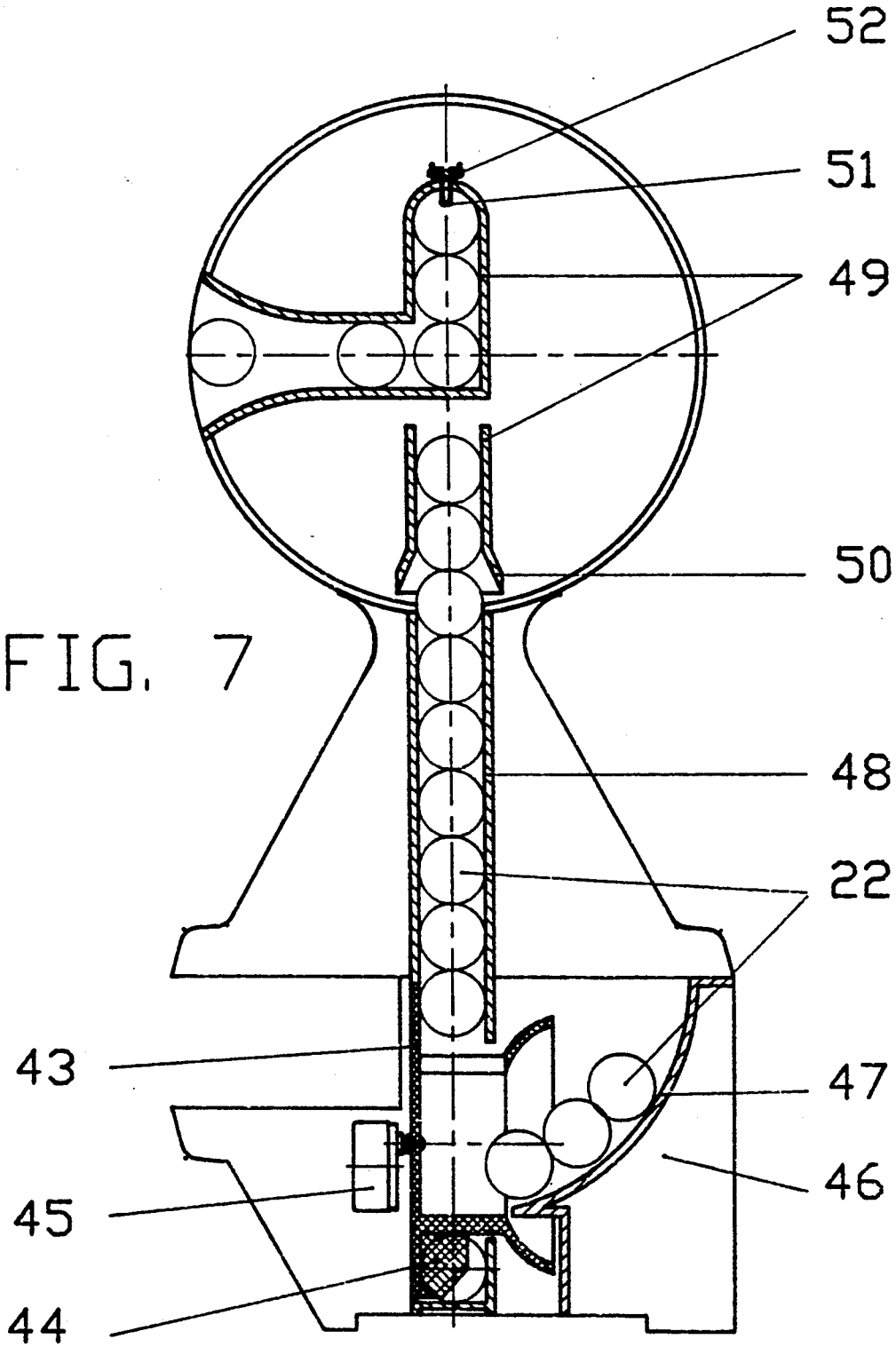
FIG. 7 is a side cross-sectional view of the ball feeding mechanism of this invention.
Figure 8:
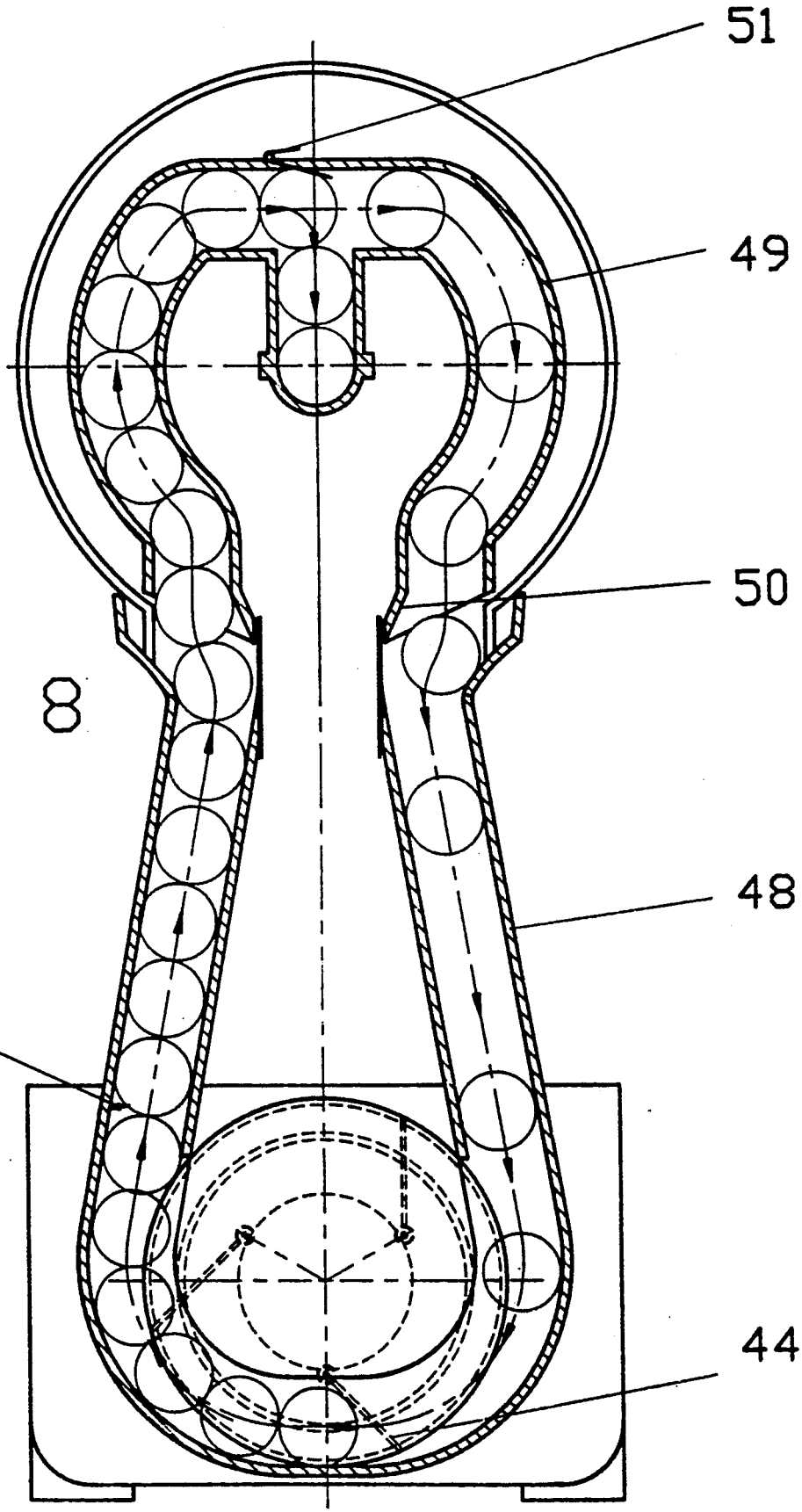
FIG. 8 is a front cross-sectional view, showing the ball feeding path.
Figure 9:
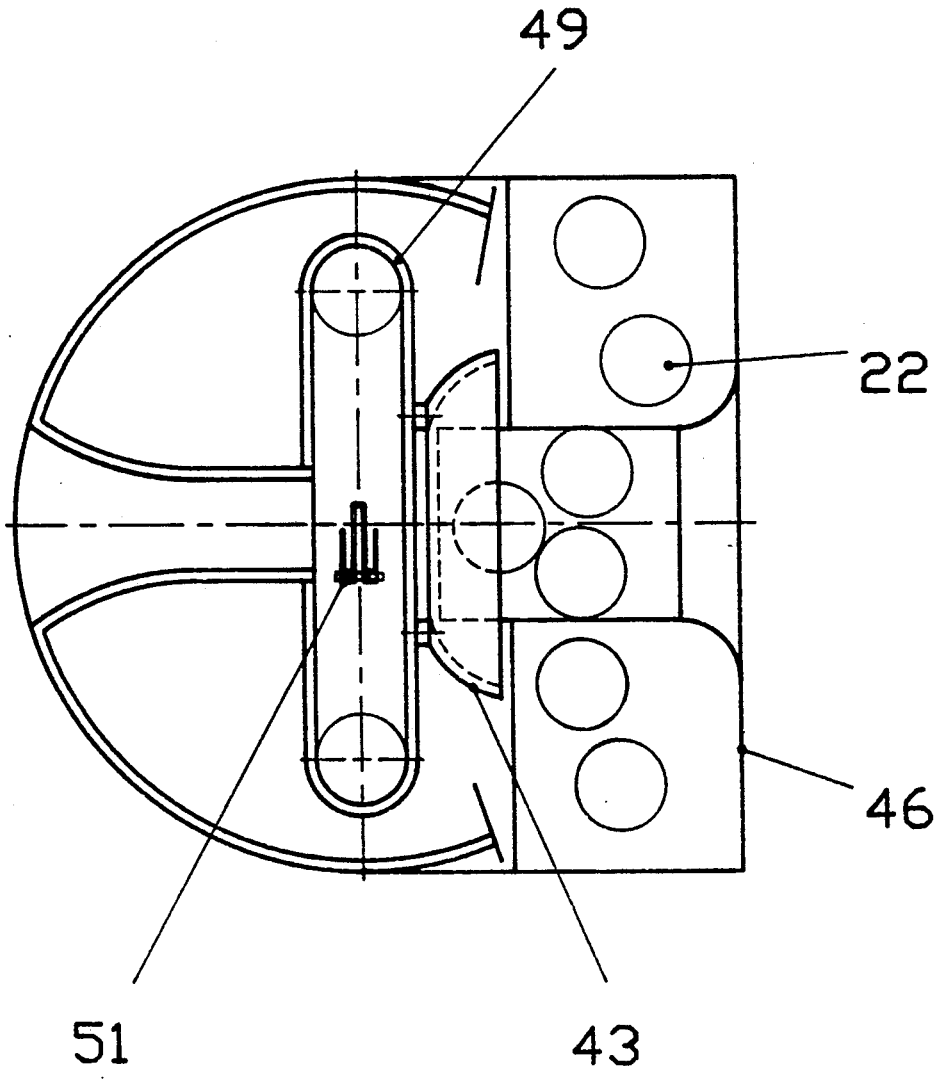
FIG. 9 is a top sectional view of the ball feeding mechanism of this invention.

Please refer to FIG. 7 wherein the ball-feeding operation is shown. A hopper slide way 47 and a ball-feeding motor 45 are disposed on a ball collector 46. A sleeve ball bag 43 is disposed at the shaft of the motor 45. One end of the ball bag 43 is closed, serving as a driving side and the other end thereof is open and inserted into the slide way 47, and three sets of blades 44 as shown in FIG. 8 and openings are disposed therein and inside a bottle-shaped fixed ball pipe 48 as shown in FIGS. 8 and 9. A movable ball pipe 49 is provided with a trumpet open end 50 and a T-shaped pipe 52 and spring 51 are fixed on the rotary eye ball member 39. When the eye ball member 39 moves, the trumpet open end 50 can join with the ball pipe 48 for smoothly sending ball thereinto. The FIG. 9 shows the ball-feeding path, wherein when the ball is regained into the ball collector 46 and slides into the sleeve ball bag 43 through the hopper slide way 47, and when the sleeve ball bag 43 rotates, due to centrifugal force, the ball 22 will slide into the bottom of the ball pipe 48 through the opening. By means of the blades 44, the ball 22 is pushed upward along the ball pipe 48 into the movable ball pipe 49 and goes through the trumpet open end 50 into the T-shaped pipe 52 located above the movable ball pipe 49 to touch a spring 51 and freely drop into the ready ball tunnel for shooting. If the ready ball tunnel is filled up with other balls, then the ball 22 will press the spring 51 to go upward through a ball-spilling pipe and slide back to the sleeve ball bag 43. The shot out ball is struck back by a player to be collected by a network into the ball collector 46. This pertains to prior art and will not be described in details.

Moreover, a leaf spring 53 is disposed on left side of the ball pipe 48 to restrict the ball 22 above the ball pipe 48 with-out sliding back to the sleeve ball bag 43 to facilitate the rotation of the blades 44. Therefore, when the ball 22 is sent from the blades 44 of the ball collector 46 to the fixed ball pipe 48 and movable ball pipe 49, by means of the spring 51 of the T-shaped pipe 5 2, the ball 22 is dropped into the ready ball tunnel 23, and then by means of the aforesaid abruptly returning mechanism of the reciprocating arm, the ball 22 is pushed forward toward the rotating mechanism, speed changing device and eye ball reciprocating mechanism, permitting the rotation direction, speed and strength of shot ball 22 to be controlled as required.

Other details and characteristics of the invention will be clearly understood by the description of the accompanying drawings which illustrate non-limiting examples of particular embodiments of the arrangement according to the invention.

I claim:

1. A ping-pong ball shooter comprising:

a) a ball shooting means including an abruptly returning mechanism for pushing a ping-pong ball;

b) a rotating mechanism operatively associated with the ball shooting means, the rotating mechanism comprising:

i) a first motor rotating a first gear;

ii) a second, larger gear engaged with the first gear to be driven thereby;

iii) a ball pipe attached to the second gear so as to accommodate a ping-pong ball therein; and iv) at least one torque spring attached to the second gear so as to rotate therewith and having a first end extending into the ball pipe and a second end, said first end adapted to engage a ping-pong ball and supply a shooting force thereto;

c) speed changing means operatively associated with the ball shooting means to control the speed of the shot ping-pong ball;

d) ball direction means including an eye ball reciprocating mechanism operatively associated with the ball shooting means to control the direction of the shot ping-pong ball; and, e) ball feeding means operatively associated with the ball shooting means.

2. A ping-pong ball shooter as claimed in claim 1 wherein said abruptly returning mechanism comprises: a) a rocking arm; b) a second motor having a driving gear; c) a driven gear engaging the driving gear; d) a crank pin on the driven gear engaging a slot defined by the rocking arm; and e) a striking head in the ball pipe attached to the rocking arm, wherein when said second motor rotates to rotate said driving gear which rotatably drives said driven gear, said crank pin rotates along therewith so as to move said rocking arm, such rocking arm movement sliding said striking head in said ball pipe.

3. The ping-pong ball shooter as claimed in claim 2 wherein the speed changing means comprises means to change the rotational speed of the second motor.

4. A ping-pong ball shooter as claimed in claim 1, further comprising: a spherical structure in which is disposed a seat member having a slide slot engaging a fixing pin formed on a rotary eye ball member, whereby said eye ball member rotates horizontally and vertically inside said spherical structure by a slide-crank mechanism; a first crank pin disposed on a transmission gear of a horizontal motor which is mounted on said rotary eye ball member whereby said first crank pin can move within a guider; a ball pin disposed on said eye ball member, which moves within a slot defined by said guider such that said eye ball member can only move horizontally relatively to said guider; and, a second crank pin disposed on a transmission gear of a vertical motor, which can move within a fixing support of said spherical structure, making said eye ball member move only vertically.

5. A ping-pong ball shooter as claimed in claim 1, wherein said ball feeding means comprises: a hopper slide way and a ball-feeding motor disposed on a collector; a sleeve ball bag disposed adjacent to the shaft of said ball-feeding motor, one end of said ball bag being closed, and the other end thereof being open and inserted into said slide way, three sets of blades and openings being disposed therein; a bottle-shaped ball pipe; a movable ball pipe provided with a trumpet-shaped open end; a T-shaped pipe; and a spring fixed on said rotary eye ball member, whereby by means of the rotation of said blades, the ping-pong ball is sent along said bottle-shaped ball pipe through said trumpet-shaped opening into the movable ball pipe, into said T-shaped pipe and to drop into a ready ball tunnel for shooting, and whereby, if said ready ball tunnel is filled with other balls, the ball will slide back to said sleeve ball bag.

6. A ping-pong ball shooter as claimed in claim 5, further comprising a leaf spring disposed on a side of said bottle-shaped ball pipe to prevent the balls above said spring from sliding back to said sleeve ball bag.

7. The ping-pong ball shooter as claimed in claim 1 further comprising means to adjust the tension of the at least one torque spring so as to vary the force with which the ball is shot.

8. The ping-pong ball shooter as claimed in claim 7 wherein the tension adjustment means comprises:

a) a pivoting lever having a first portion in contact with the second end of the torque spring and a second portion;

b) a rotatable cam in operative association with the second portion of the pivoting lever; and, c) cam rotating means to rotate the cam means, such rotation causing the lever to pivot thereby adjusting the tension in the torque spring.

9. The ping-pong ball shooter as claimed in claim 8 wherein the cam rotating means comprises:

a) a third motor driving a third gear; and, b) a fourth gear operatively associated with the rotatable cam and driven by the third gear.

10. The ping-pong ball shooter as claimed in claim 9 further comprising switch means operatively associated with the cam.

* * * * *